US008384636B2

(12) United States Patent
Chiu et al.

(10) Patent No.: US 8,384,636 B2
(45) Date of Patent: Feb. 26, 2013

(54) OVERDRIVING APPARATUS AND METHOD THEREOF

(75) Inventors: Chun-Chieh Chiu, Taoyuan County (TW); Yue-Li Chao, Taoyuan County (TW); Chien-Hung Chen, Taipei County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 451 days.

(21) Appl. No.: 12/748,460

(22) Filed: Mar. 29, 2010

(65) Prior Publication Data

US 2011/0169851 A1 Jul. 14, 2011

(30) Foreign Application Priority Data

Jan. 13, 2010 (TW) ..... 99100810 A

(51) Int. Cl.
*G09G 3/36* (2006.01)

(52) U.S. Cl. ..... 345/89

(58) Field of Classification Search ..... 345/87–104, 345/211–213
See application file for complete search history.

(56) References Cited

U.S. PATENT DOCUMENTS

| | | | | |
|---|---|---|---|---|
| 7,262,818 | B2 | 8/2007 | Chuang et al. | |
| 2005/0036075 | A1 * | 2/2005 | Taoka et al. | 348/761 |
| 2008/0211753 | A1 * | 9/2008 | Tsai et al. | 345/87 |
| 2009/0153456 | A1 * | 6/2009 | Tsai et al. | 345/89 |
| 2009/0213050 | A1 * | 8/2009 | Hung | 345/87 |

* cited by examiner

*Primary Examiner* — Chanh Nguyen
*Assistant Examiner* — Sanghyuk Park
(74) *Attorney, Agent, or Firm* — Jianq Chyun IP Office

(57) ABSTRACT

An overdriving apparatus including a memory unit, a position unit and an overdriving unit is provided. The memory unit stores a present frame received and outputs a previous frame stored in the memory unit. The position unit generates pixel position information according to a display control signal of the present frame. The overdriving unit determines a corresponding relationship between several pixel grey values of the present frame and several display areas of a display panel according to the pixel position information, so as to select a corresponding specific table group of each of the pixel grey values from a plurality of overdriving tables. The overdriving unit further generates an overdriving frame by looking up the corresponding specific table group of each of the pixel grey values.

6 Claims, 5 Drawing Sheets

OVERDRIVING APPARATUS AND METHOD THEREOF

CROSS-REFERENCE TO RELATED APPLICATION

This application claims the priority benefit of Taiwan application serial no. 99100810, filed on Jan. 13, 2010. The entirety of the above-mentioned patent application is hereby incorporated by reference herein and made a part of specification.

BACKGROUND OF THE INVENTION

1. Technical Field

The invention generally relates to an overdriving apparatus of a display panel and an overdriving method thereof, and more particularly, to an overdriving apparatus generating an overdriving frame according to an overdriving table of response times of different liquid crystals and an overdriving method thereof.

2. Related Art

With the advancement of display technology, three-dimensional display devices (3D display device) capable of displaying 3D images gradually become main research topics in the display device field. FIG. 1A is a schematic diagram illustrating playing of a three-dimensional display apparatus. As illustrated in FIG. 1A, 3D display devices are usually used in corporation with shutter glasses. Besides, during a process of playing images, when odd number images IMG11, IMG13 . . . reach the stable status, a left eye of an observer is covered by the shutter glasses so that just a right eye is able to see the image. Then, when even number images IMG12, IMG14 . . . reach the stable status, the right eye of the observer is covered by the shutter glasses so that just the left eye is able to see the image. Accordingly, the left eye and the right eye of the observer are able to respectively receive images at different angles, and the images are thereby combined to achieve the 3D effect.

In order to ensure the images reach the stable status, the present 3D display devices mostly drive the liquid crystal display panel by an overdriving method, so as to speed up a response time of the liquid crystals. FIG. 1B is a structure schematic diagram illustrating an overdriving apparatus of a conventional three-dimensional display apparatus. Referring to FIG. 1B, the overdriving apparatus 100 includes a memory unit 110 and an overdriving circuit 120. The memory unit 110 stores a present display frame IMG11, and transmits a previous display frame IMG12 to the overdriving circuit 120. The overdriving circuit 120 stores an overdriving table. Accordingly, the overdriving circuit 120 looks up the overdriving table according to the previous display frame IMG12 and the present display frame IMG11, and generates the overdriving display frame according to the query result.

It is to be noted that, the overdriving table stored in the overdriving circuit 120 is established based upon response times of the liquid crystals on a middle scanning line of the liquid crystal display panel. However, the liquid crystal penal is driven in a sequential scanning approach. That is, there are different requirements on time for liquid crystals located on different scanning lines to reach the stable status. Therefore, under a condition where the conventional overdriving circuit 120 is based upon the response times of the liquid crystals on the middle scanning line, the generated overdriving frame would cause too strong transitions of the liquid crystals on an upper area of the display panel and insufficient transitions of the liquid crystals on a lower area of the display panel.

Accordingly, the 3D imaged watched by the observer would have a problem of a cross-talk between stereo images, and thereby lower the 3D image quality.

SUMMARY

The invention is directed to an overdriving apparatus, which utilizes a plurality of overdriving tables established based upon response times of different liquid crystals to execute a conversion of pixel grey values, and thus make the overdriving frame obtained by such a conversion avoid a disadvantage of too strong liquid crystal transitions or insufficient liquid crystal transitions.

The invention is directed to an overdriving method, which selects different overdriving tables according to a corresponding relationship between pixel grey values and display areas, and executes a conversion of pixel grey values according to the response times of different liquid crystals, and thereby increases display quality of the liquid crystal panel.

The invention proposes an overdriving apparatus adapted for generating an overdriving frame so as to drive a display panel including a plurality of display areas. The overdriving apparatus includes a memory unit, a position unit and an overdriving unit. The memory unit stores a present image received, and outputs a previous frame stored in the memory unit. The position unit generates pixel position information according to a display control signal of the present frame. The overdriving unit determines a corresponding relationship between a plurality of pixel grey values of the present frame and the display areas according to the pixel position information, so as to select a corresponding specific table group of each of the pixel grey values. In addition, the overdriving unit further generates the overdriving frame by looking up the corresponding specific table group of each of the pixel grey values, where the overdriving tables are corresponding to a portion of the display areas, and are established according to the response times of the liquid crystals corresponding to the portion of the display areas.

In an embodiment of the invention, the overdriving unit includes a storage device, a selector and a data arithmetic device, where the storage device stores the overdriving tables. The selector determines the display areas respectively corresponding to the pixel grey values in the present frame according to the pixel position information, and selects the corresponding specific table group of each of the pixel grey values from the overdriving tables according to the display areas respectively corresponding to the pixel grey values. The data arithmetic device looks up the specific table group according to the present frame and the previous frame so as to acquire a first overdriving value and a second overdriving value. In addition, the data arithmetic device enters the first overdriving value, the second overdriving value and an area value of each of the display areas respectively corresponding to each of the pixel grey values into a mathematical formula so as to convert the pixel grey values into a plurality of overdriving grey values, and the overdriving unit generates the overdriving frame according to the overdriving grey values.

From another perspective, the invention proposes an overdriving method adapted for generating an overdriving frame so as to drive a display panel including a plurality of display areas. The overdriving method includes the following steps: a plurality of overdriving tables are established according to response times of liquid crystals of a portion of the display areas; a present frame is stored and a previous frame stored is transmitted; pixel position information is generated according to the display control signal of the present frame; a corresponding relationship between a plurality of pixel grey values of the present frame and the display areas is determined according to the pixel position information, and a corresponding specific table group of each of the pixel grey values is selected from the overdriving tables; and the corresponding specific table group of each of the pixel grey values is looked up, so as to convert the pixel grey values into a plurality of overdriving grey values and generate the overdriving frame according to the overdriving grey values.

In view of the above, the invention utilizes a plurality of overdriving tables established based upon response times of different liquid crystals to execute a conversion of pixel grey values. In addition, during a conversion process of the pixel grey values, different overdriving tables are selected according to the display areas corresponding to the pixel grey values. Accordingly, the overdriving apparatus can generate an overdriving frame in response to requirements corresponding to response times of different liquid crystals of each display area, and avoid disadvantages of too strong liquid crystal transitions or insufficient liquid crystal transitions, thereby increasing the image quality of the display panel.

It is to be understood that both the foregoing general description and the following detailed description are exemplary, and are further intended to provide the explanation of the present disclosure as claimed.

BRIEF DESCRIPTION OF THE DRAWINGS

The accompanying drawings are included to provide a further understanding of the invention, and are incorporated in and constitute a part of this specification. The drawings illustrate embodiments of the invention and serve to explain the principles of the invention together with the description.

DESCRIPTION OF THE EXEMPLARY EMBODIMENTS

Figure 1A:
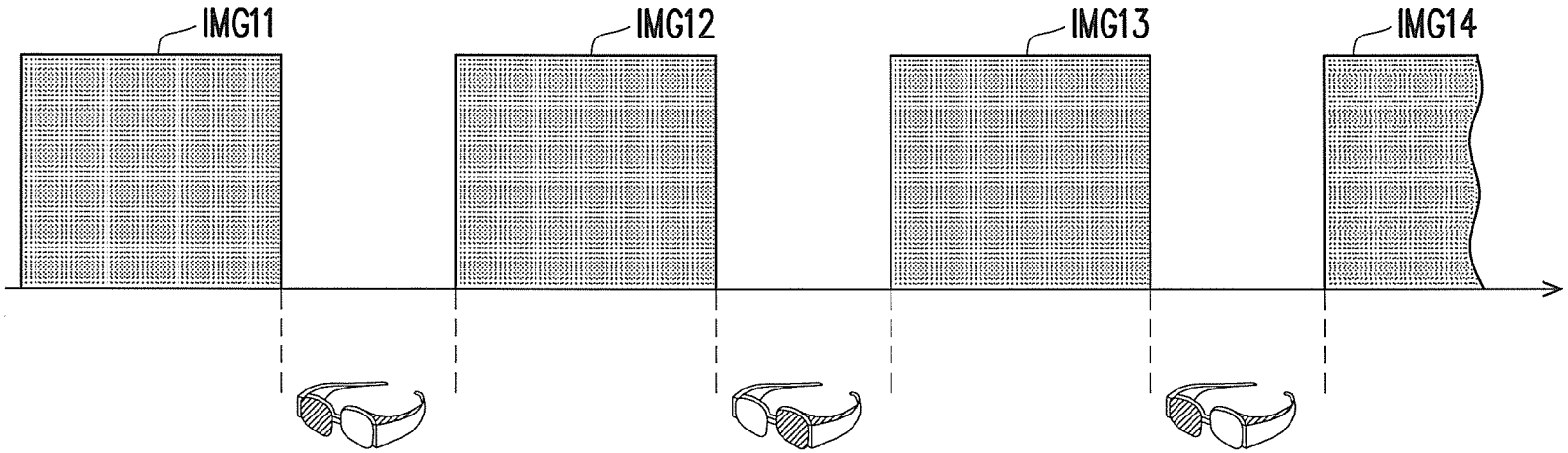
FIG. 1A (RELATED ART)
FIG. 1A is a schematic diagram illustrating playing of a three-dimensional display apparatus.
Figure 1B:
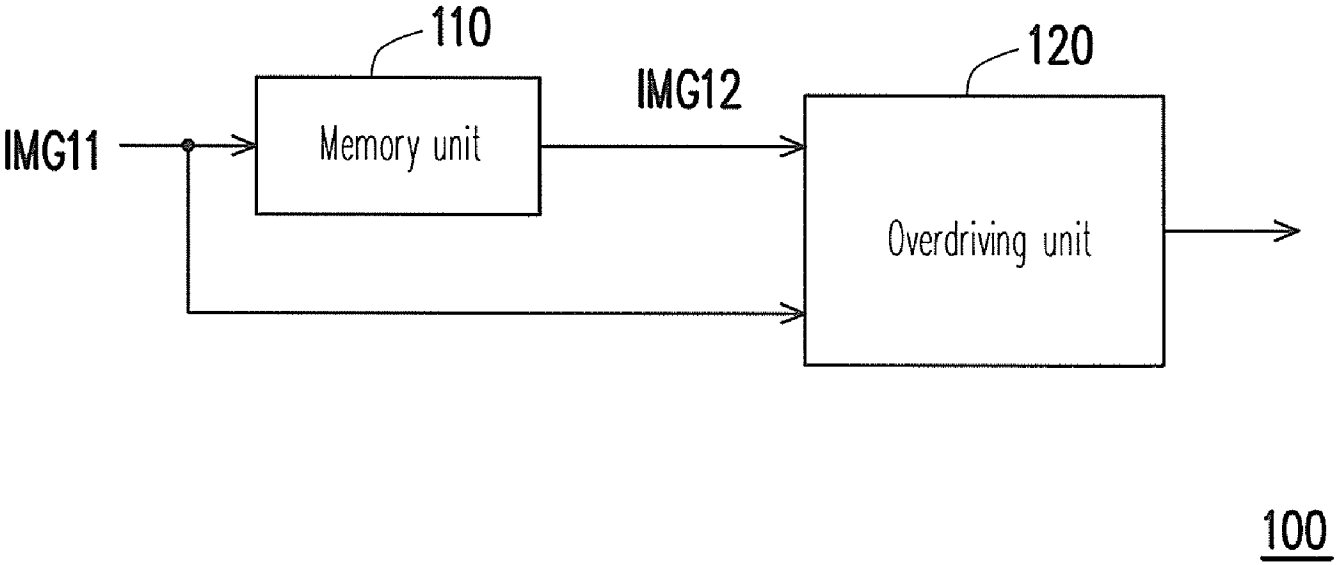
FIG. 1B (RELATED ART)
FIG. 1B is a structure schematic diagram illustrating an overdriving apparatus of a conventional three-dimensional display apparatus.

Reference will now be made in detail to the exemplary embodiments of the invention, examples of which are illustrated in the accompanying drawings. Wherever possible, the same reference numbers are used in the drawings and the description to refer to the same or like parts.

Figure 2:
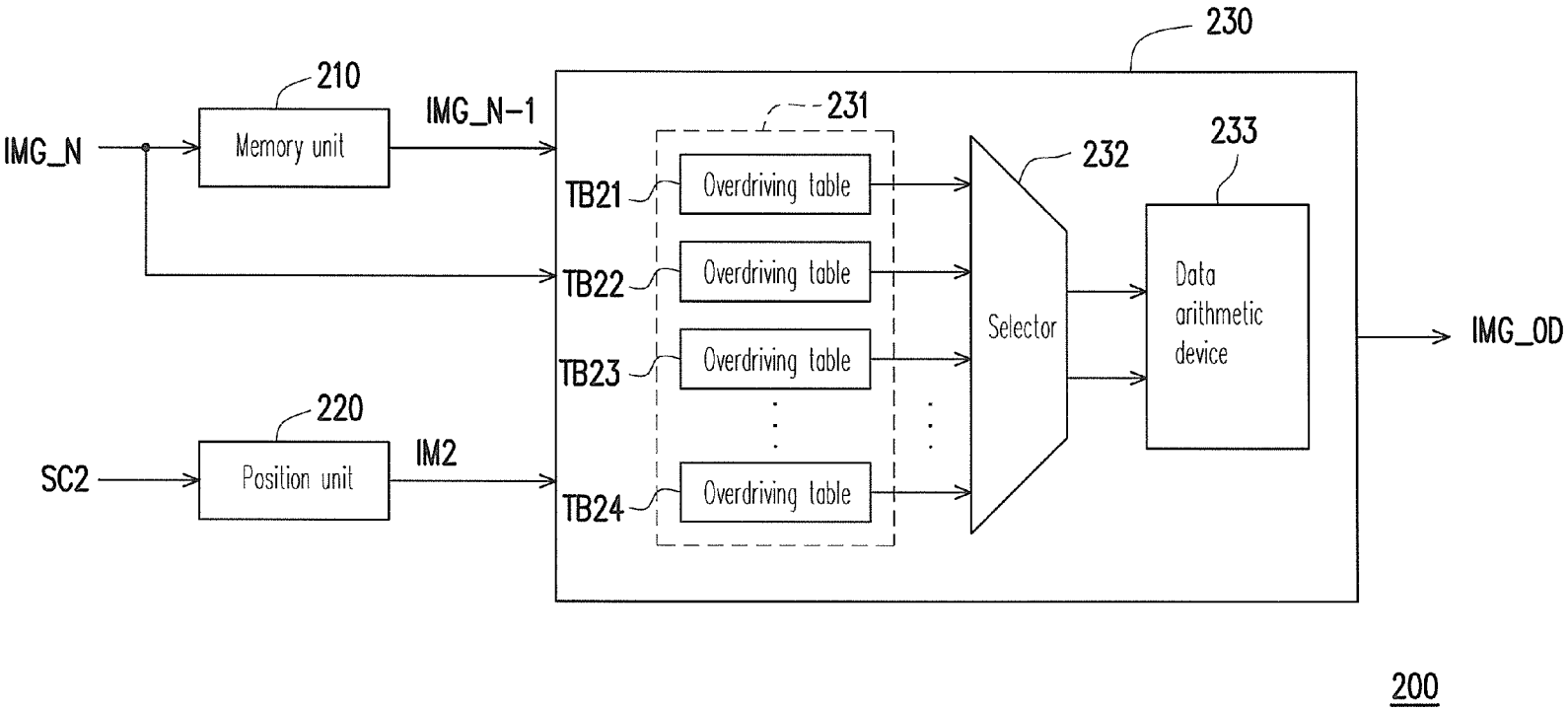
FIG. 2 is a schematic block diagram illustrating an overdriving apparatus according to an embodiment of the invention.
Figure 3:
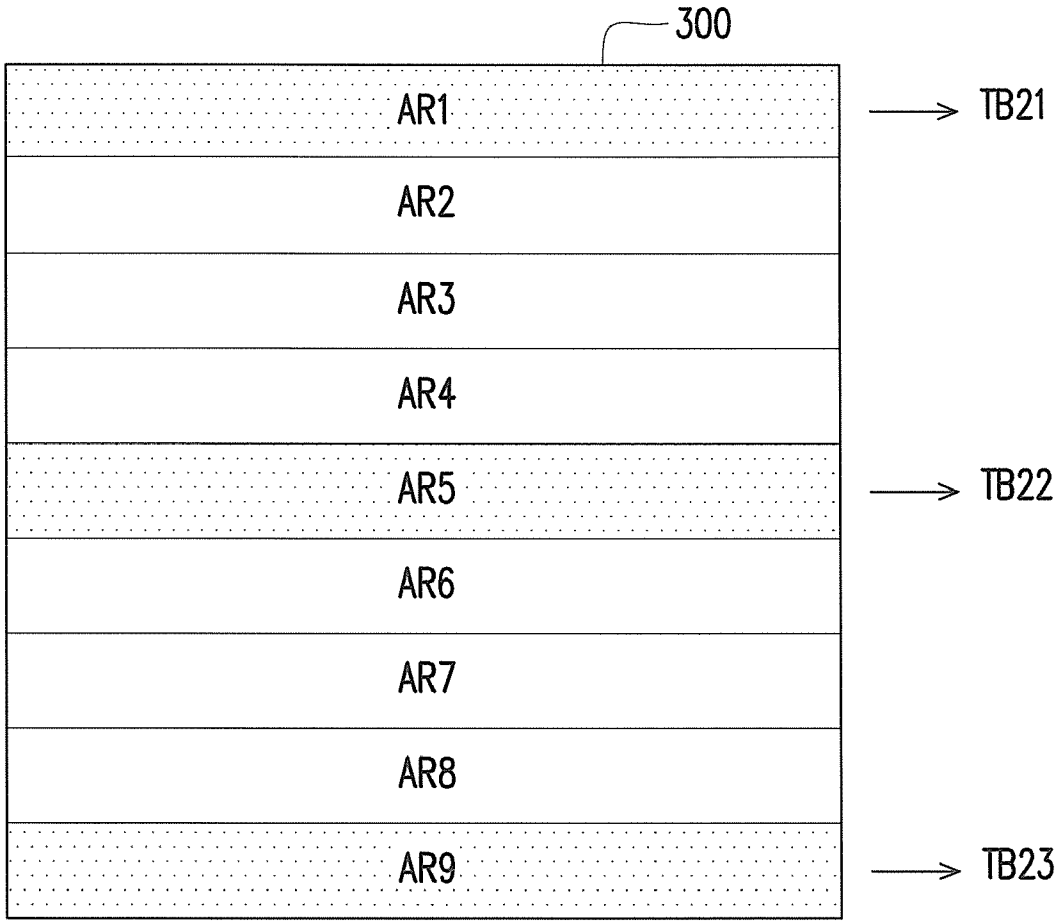
FIG. 3 is a schematic diagram illustrating a display panel according to an embodiment of the invention.

FIG. 2 is a schematic block diagram illustrating an overdriving apparatus according to an embodiment of the invention. Referring to FIG. 2, an overdriving apparatus 200 includes a memory unit 210, a position unit 220 and an overdriving unit 230, where the overdriving apparatus 200 generates an overdriving image IMG_OD, so as to drive a display panel including a plurality of display areas. For simplicity of illustration, FIG. 3 is a schematic diagram illustrating a display panel according to an embodiment of the invention, where the display panel 300 includes 9 of display areas AR1-AR9, and this also means that N=9. Although FIG. 3 illustrates an embodiment type of the display panel, but the invention is not limited thereto, and an operation of the overdriving apparatus 200 will be described in accordance with the display panel 300 illustrated by FIG. 3.

In an overall operation, the memory unit 210 stores a present image IMG_N received, and outputs a previous frame IMG_N−1 stored in the memory unit 210. Therefore, with respect to the overdriving unit 230, the present image IMG_N and the previous frame IMG_N−1 are simultaneously received by the overdriving unit 230. On the other hand, the position unit 220 generates pixel position information IM2 according to a display control signal SC2 of the present image IMG_N, where the display control signal SC2 of the present image IMG_N is, for example, a combination of a vertical synchronization signal, a horizontal synchronization signal and a data enable signal. In addition, there are a plurality of overdriving tables stored in the overdriving unit 230, and the overdriving tables are respectively corresponding to a portion of the display areas in the display panel 300 and are established according to response times of different liquid crystals.

Take FIG. 3 as an example, assuming there are three overdriving tables stored in the overdriving unit 230, where the three overdriving tables are corresponding to the display areas AR1, AR5 and AR9. Also, as can be known according to the driving method of a sequential scanning of the display panel 300, the response times required by the liquid crystals located on the upper region of display panel 300 are longer and this means that the liquid crystals require smaller overdriving grey values. Comparatively, the response times required by the liquid crystals located on the lower region of display panel 300 are shorter, and this means that the liquid crystals require larger overdriving grey values. Therefore, under a condition where the overdriving tables are established according to the response times of the liquid crystals corresponding to the display areas AR1, AR5 and AR9, overdriving tables which are established according to the response times of different liquid crystals are stored in the overdriving unit 230.

Moreover, the overdriving unit 230 determines a corresponding relationship between a plurality of pixel grey values of the present frame IMG_N and the display areas according to the pixel position information IM2, so as to select a corresponding specific table group of each of the pixel grey values from the overdriving tables, and generate the overdriving image IMG_OD by looking up the corresponding specific corresponding table group of each to the pixel grey values. In other words, the overdriving unit 230 selects different overdriving tables to respectively convert each of the pixel grey values according to driving positions of each of the pixel grey values corresponding to the display panel. Accordingly, the overdriving unit 230 can adjust each of the pixel grey values in response to the response times of the liquid crystals required by different display areas. Comparatively, the overdriving image IMG_OD generated by the overdriving unit 230 can avoid disadvantages of too strong liquid crystal transitions or insufficient liquid crystal transitions, and thereby increase the image quality of the display panel.

To be more specific, as illustrated in FIG. 2, the overdriving unit 230 includes a storage device 231, a selector 232 and a data arithmetic device 233. The storage device 231 stores a plurality of overdriving tables TB21-TB24. The selector 232 determines the display areas respectively corresponding to the pixel grey values in the present frame IMG_N according to the pixel position information IM2, and selects the corresponding specific table group of each of the pixel grey values from the overdriving tables according to the display areas respectively corresponding to the pixel grey values.

Take FIG. 3 as an example, assuming the storage device 231 just includes three overdriving tables TB21-TB23, and the overdriving tables TB21-TB23 are respectively corresponding to the display areas AR1, AR5 and AR9. When the pixel grey value currently being converted by the overdriving unit 230 is corresponding to the display area AR2, the selector 232 selects the overdriving tables TB21 and TB22 respectively corresponding to the display areas AR1 and AR5 from the overdriving tables TB21-TB23 as the specific table group. Similarly, if the pixel grey value currently being converted by the overdriving unit 230 is corresponding to the display area AR6, the selector 232 selects the overdriving tables TB22 and TB23 respectively corresponding to the display areas AR5 and AR9 from the overdriving tables TB21-TB23 as the specific table group. In other words, the selector 232 selects two overdriving tables according to the display areas corresponding to the pixel grey values, where the two display areas corresponding to the two overdriving tables are neighboring to the display areas corresponding to the pixel grey values.

On the other hand, the data arithmetic device 233 looks up the specific table group according to the present image IMG_N and the previous frame IMG_N−1, so as to acquire a first overdriving value and a second overdriving value. For example, the data arithmetic device 233 looks up the pixel grey values of the present image IMG_N and the previous frame IMG_N−1 one by one, and looks up the two overdriving tables in the specific table group according to the acquired pixel grey values. Thus, if the resolution of the frame is 8 bits, the two overdriving tables being looked up are Table 1 and Table 2, and the two pixel grey values acquired by the data arithmetic device 233 from the present image IMG_N and the previous frame IMG_N−1 are 128 and 32, then referring to Table 1 and Table 2, the data arithmetic device 233 may acquire the first overdriving value {152} and the second overdriving value {186}.

TABLE 1

| | Previous Frame | | | | | | | | | | | | | | | | | |
|---|---|---|---|---|---|---|---|---|---|---|---|---|---|---|---|---|---|---|
| Present Frame | | 0 | 16 | 32 | 48 | 64 | 80 | 96 | 112 | 128 | 144 | 160 | 176 | 192 | 208 | 224 | 240 | 255 |
| | 0 | 0 | 0 | 0 | 0 | 0 | 0 | 0 | 0 | 0 | 0 | 0 | 0 | 0 | 0 | 0 | 0 | 0 |
| | 16 | 16 | 16 | 16 | 16 | 16 | 16 | 16 | 16 | 16 | 16 | 16 | 16 | 16 | 16 | 16 | 16 | 16 |
| | 32 | 32 | 32 | 32 | 32 | 32 | 32 | 32 | 32 | 32 | 32 | 32 | 32 | 32 | 32 | 32 | 32 | 32 |
| | 48 | 52 | 52 | 50 | 48 | 47 | 47 | 47 | 47 | 47 | 47 | 47 | 47 | 47 | 43 | 43 | 49 | 49 |
| | 64 | 80 | 76 | 72 | 68 | 64 | 63 | 63 | 63 | 63 | 63 | 63 | 59 | 57 | 55 | 50 | 46 | 46 |
| | 80 | 104 | 99 | 96 | 88 | 84 | 80 | 77 | 75 | 75 | 69 | 69 | 66 | 62 | 62 | 58 | 48 | 48 |
| | 96 | 132 | 124 | 116 | 112 | 101 | 101 | 96 | 82 | 88 | 85 | 83 | 76 | 72 | 69 | 63 | 55 | 55 |
| | 112 | 156 | 147 | 135 | 135 | 125 | 121 | 116 | 112 | 107 | 103 | 99 | 91 | 87 | 79 | 74 | 63 | 63 |
| | 128 | 176 | 169 | 152 | 156 | 148 | 146 | 140 | 134 | 128 | 123 | 115 | 111 | 100 | 95 | 87 | 71 | 71 |
| | 144 | 208 | 193 | 182 | 180 | 172 | 168 | 161 | 156 | 152 | 144 | 137 | 131 | 122 | 112 | 104 | 87 | 87 |
| | 160 | 224 | 216 | 204 | 205 | 190 | 189 | 184 | 180 | 176 | 168 | 160 | 150 | 142 | 134 | 123 | 102 | 102 |
| | 176 | 236 | 234 | 233 | 230 | 220 | 220 | 215 | 208 | 200 | 193 | 186 | 176 | 167 | 157 | 141 | 121 | 121 |
| | 192 | 248 | 246 | 248 | 244 | 244 | 241 | 237 | 232 | 229 | 222 | 214 | 207 | 192 | 180 | 167 | 142 | 142 |
| | 208 | 255 | 255 | 255 | 255 | 250 | 250 | 248 | 248 | 245 | 242 | 236 | 228 | 221 | 208 | 191 | 173 | 173 |
| | 224 | 255 | 255 | 255 | 255 | 255 | 255 | 255 | 255 | 255 | 255 | 248 | 248 | 245 | 237 | 224 | 198 | 198 |
| | 240 | 255 | 255 | 255 | 255 | 255 | 255 | 255 | 255 | 255 | 255 | 255 | 255 | 255 | 255 | 255 | 240 | 239 |
| | 255 | 255 | 255 | 255 | 255 | 255 | 255 | 255 | 255 | 255 | 255 | 255 | 255 | 255 | 255 | 255 | 255 | 255 |

TABLE 2

| | Previous Frame | | | | | | | | | | | | | | | | | |
|---|---|---|---|---|---|---|---|---|---|---|---|---|---|---|---|---|---|---|
| Present Frame | | 0 | 16 | 32 | 48 | 64 | 80 | 96 | 112 | 128 | 144 | 160 | 176 | 192 | 208 | 224 | 240 | 255 |
| | 0 | 0 | 0 | 0 | 0 | 0 | 0 | 0 | 0 | 0 | 0 | 0 | 0 | 0 | 0 | 0 | 0 | 0 |
| | 16 | 16 | 16 | 16 | 16 | 16 | 16 | 16 | 16 | 16 | 16 | 16 | 16 | 16 | 16 | 16 | 16 | 16 |
| | 32 | 36 | 36 | 32 | 32 | 32 | 32 | 32 | 32 | 32 | 32 | 32 | 32 | 32 | 32 | 31 | 27 | 22 |
| | 48 | 60 | 56 | 52 | 48 | 47 | 47 | 47 | 47 | 43 | 43 | 43 | 43 | 41 | 39 | 33 | 31 | 27 |
| | 64 | 104 | 88 | 79 | 72 | 64 | 63 | 63 | 59 | 59 | 55 | 55 | 51 | 47 | 47 | 47 | 39 | 38 |
| | 80 | 140 | 116 | 104 | 96 | 84 | 80 | 79 | 71 | 67 | 62 | 60 | 59 | 55 | 52 | 51 | 43 | 43 |
| | 96 | 178 | 145 | 132 | 123 | 108 | 104 | 96 | 91 | 87 | 79 | 75 | 67 | 63 | 59 | 55 | 47 | 46 |
| | 112 | 217 | 172 | 156 | 145 | 132 | 128 | 120 | 112 | 107 | 99 | 91 | 83 | 87 | 75 | 67 | 59 | 55 |
| | 128 | 243 | 200 | 186 | 171 | 161 | 152 | 144 | 136 | 128 | 119 | 111 | 99 | 91 | 83 | 70 | 57 | 57 |
| | 144 | 255 | 227 | 211 | 201 | 188 | 180 | 172 | 164 | 152 | 144 | 135 | 123 | 110 | 99 | 87 | 71 | 71 |
| | 160 | 255 | 244 | 237 | 233 | 216 | 212 | 204 | 192 | 184 | 172 | 160 | 151 | 134 | 123 | 107 | 83 | 83 |
| | 176 | 255 | 251 | 248 | 248 | 240 | 240 | 233 | 224 | 216 | 205 | 188 | 176 | 163 | 147 | 130 | 103 | 102 |
| | 192 | 255 | 255 | 255 | 255 | 255 | 255 | 245 | 245 | 242 | 234 | 225 | 212 | 192 | 179 | 163 | 127 | 118 |
| | 208 | 255 | 255 | 255 | 255 | 255 | 255 | 255 | 255 | 255 | 248 | 244 | 236 | 226 | 208 | 187 | 155 | 134 |
| | 224 | 255 | 255 | 255 | 255 | 255 | 255 | 255 | 255 | 255 | 255 | 255 | 255 | 248 | 240 | 224 | 191 | 165 |
| | 240 | 255 | 255 | 255 | 255 | 255 | 255 | 255 | 255 | 255 | 255 | 255 | 255 | 255 | 255 | 255 | 240 | 237 |
| | 255 | 255 | 255 | 255 | 255 | 255 | 255 | 255 | 255 | 255 | 255 | 255 | 255 | 255 | 255 | 255 | 255 | 255 |

Moreover, the data arithmetic device 233 further enters the first overdriving value, the second overdriving value and the area values of the display areas respectively corresponding to the pixel grey values into a mathematical formula, so as to convert the pixel grey values into a plurality of overdriving grey values, and the overdriving unit 230 generates the overdriving frame according to the overdriving grey values. When the area value of each of the display areas respectively corresponding to the pixel grey values are ARi, and the first overdriving value, the second overdriving value and the area values of the display areas respectively corresponding to the specific table groups are respectively VO1, VO2, AR1 and AR2, then the mathematical formula which is used to respectively convert the pixel grey values ODi into the corresponding overdriving grey values is expressed as the equation (1):

$$ODi = VO1 \pm \frac{ARi - AR1}{AR2 - AR1}(VO1 - VO2). \qquad \text{equation (1)}$$

For example, when the display area corresponding to the pixel grey value currently being processed by the data arithmetic device 233 is AR3, the Table 1 and Table 2 are the overdriving tables respectively corresponding to the display areas AR1 and AR5, the first overdriving value and the second overdriving value respectively acquired from Table 1 and Table 2 are 152 and 186, then the overdriving grey value OD calculated according to the equation (1) is:

$$OD = 152 - \frac{3-1}{5-1}(152 - 168) = 169.$$

It is to be noted that, since the pixel grey values at this time are changed from low to high, thus the overdriving grey value OD is acquired by subtracting the subsequent number form the first overdriving value VO1. Comparatively, if the pixel grey values are changed from high to low, then the overdriving grey value OD is acquired by adding the first overdriving value VO1 with the subsequent number.

Figure 4:
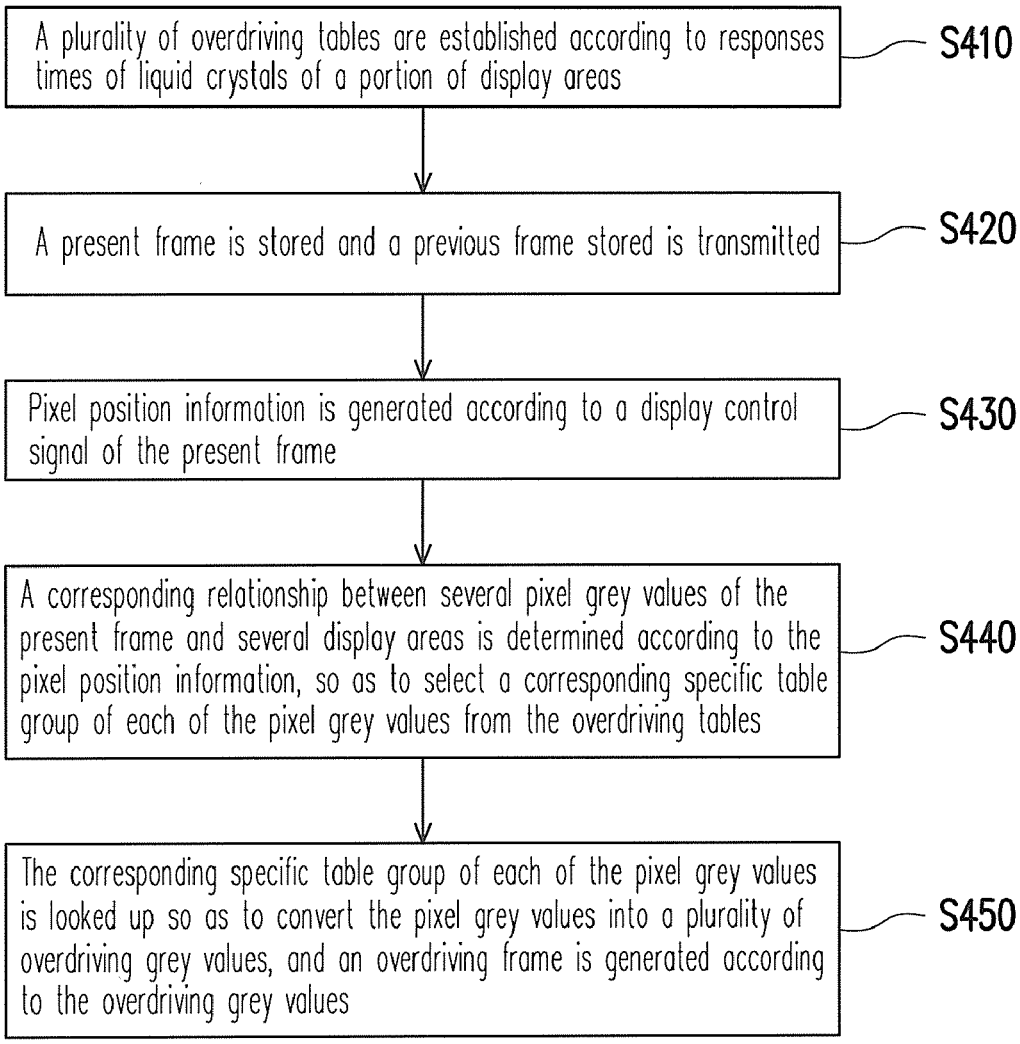
FIG. 4 is a flow chart illustrating an overdriving method according to an embodiment of the invention.

From another perspective, FIG. 4 is a flow chart illustrating an overdriving method according to an embodiment of the invention, where the overdriving method is adapted for generating an overdriving frame, so as to drive a display panel including a plurality of display areas. Referring to FIG. 4, first at step S410, a plurality of overdriving tables are established according to the response times of the liquid crystals of a portion of the display areas of the display panel. Then, at step S420, a present frame is stored, and a previous frame stored is transmitted. Moreover, at step S430, pixel position information is generated according to a display control signal of the present frame, and at step S440, a corresponding relationship between a plurality of pixel grey values of the present frame and the display areas is determined according to the pixel position information, so as to select a corresponding specific table group of each of the pixel grey values from the overdriving tables. Thereby, at step S450, the specific group tables respectively corresponding to the pixel grey value are looked up, so as to convert the pixel grey values into a plurality of overdriving grey values and generate the overdriving frame according to the overdriving grey values. A detailed process of the overdriving method illustrated by the present embodiment has been included in the aforementioned embodiment so they will not be described herein.

In summary, the overdriving apparatus of the invention performs a conversion of pixel grey values according to a plurality of overdriving tables, where the overdriving tables are respectively established based upon the response times of different liquid crystals. In addition, during the process of the overdriving apparatus converting the pixel grey values, different overdriving tables are selected according to the display areas corresponding to the pixel grey values. Accordingly, the overdriving frame generated by the overdriving apparatus can avoid disadvantages of too strong liquid crystal transitions or insufficient liquid crystal transitions, and thereby increase the image quality of the display panel.

It will be apparent to those skilled in the art that various modifications and variations of the exemplary embodiments can be made to the structure of the invention without departing from the scope or spirit of the invention. In view of the foregoing descriptions, it is intended that the present disclosure covers modifications and variations of the exemplary embodiments if they fall within the scope of the following claims and their equivalents.

What is claimed is:

1. An overdriving apparatus, adapted for generating an overdriving frame to drive a display panel comprising a plurality of display areas, the overdriving apparatus comprising:

a memory unit, storing a present frame received and outputting a previous frame stored in the memory unit;

a position unit, generating pixel position information according to a display control signal of the present frame; and an overdriving unit, determining a corresponding relationship between a plurality of pixel grey values of the present frame and the display areas according to the pixel position information, so as to select a corresponding specific table group of each of the pixel grey values from a plurality of overdriving tables and generate the overdriving frame by looking up the corresponding specific table group of each of the pixel grey value, wherein the overdriving tables are corresponding to a portion of the display areas and are established according to response times of liquid crystals corresponding to the portion of the display areas, and the overdriving unit comprises:

a data arithmetic device, looking up the specific table group according to the present frame and the previous frame so as to acquire a first overdriving value and a second overdriving value, and entering the first overdriving value, the second overdriving value and an area value of each of the display areas respectively corresponding to the pixel grey values into a mathematical formula so as to convert the pixel grey values into a plurality of overdriving grey values, wherein the overdriving unit generates the overdriving frame according to the overdriving grey values, and when the area value of each of the display areas respectively corresponding to the pixel grey values are ARi, and the first overdriving value, the second overdriving value and the area values of the display areas respectively corresponding to the specific table groups are respectively V01, V02, AR1 and AR2, the mathematical formula which is used to convert each of the pixel grey values into the corresponding overdriving grey value ODi is expressed as:

$$ODi = VO1 \pm \frac{ARi - AR1}{AR2 - AR1}(VO1 - VO2).$$

2. The overdriving apparatus according to claim 1, wherein the overdriving unit acquires the pixel grey values of the present frame one by one and determines a corresponding display area of each of the pixel grey values according to the pixel position information, and the overdriving unit further selects the corresponding specific table group of each of the pixel grey values according to the corresponding display area of each of the pixel grey values.

3. The overdriving apparatus according to claim 1, wherein the overdriving unit further comprises:

a storage device, storing the overdriving tables; and a selector, determining the display areas respectively corresponding to the pixel grey values in the present frame according to the pixel position information, and selecting the corresponding specific table group of each of the pixel grey values from the overdriving tables according to the display areas respectively corresponding to the pixel grey values.

4. The overdriving apparatus according to claim 1, wherein the display control signal of the present frame comprises a vertical synchronization signal, a horizontal synchronization signal and a data enable signal.

5. An overdriving method, adapted for generating an overdriving frame to drive a display panel comprising a plurality of display areas, the overdriving method comprising:

establishing a plurality of overdriving tables according to response times of liquid crystals of a portion of the display areas;

storing a present frame and transmitting a previous frame stored;

generating pixel position information according to the display control signal of the present frame;

determining a corresponding relationship between a plurality of pixel grey values of the present frame and the display areas according to the pixel position information and selecting a specific table group of each of the pixel grey values from the overdriving tables;

looking up the specific table group according to the present frame and the previous frame to acquire a first overdriving value and a second overdriving value;

entering the first overdriving value, the second overdriving value and an area value of each of the display areas respectively corresponding to the pixel grey values into a mathematical formula so as to convert the pixel grey values into a plurality of overdriving grey values, wherein when the area value of each of the display areas respectively corresponding to the pixel grey values are ARi, and the first overdriving value, the second overdriving value and the area values of the display areas respectively corresponding to the specific table groups are respectively V01, VO2 AR1 and AR2 the mathematical formula which is used to convert each of the pixel grey values into the corresponding overdriving grey value ODi is expressed as:

$$ODi = VO1 \pm \frac{ARi - AR1}{AR2 - AR1}(VO1 - VO2); \text{ and}$$

generate generating the overdriving frame according to the overdriving grey values.

6. The overdriving method according to claim 5, wherein the display control signal of the present frame comprises a vertical synchronization signal, a horizontal synchronization signal and a data enable signal.

* * * * *